United States Patent [19]

Barnes

[11] Patent Number: 4,589,427

[45] Date of Patent: May 20, 1986

[54] SMOKING APPARATUS

[76] Inventor: Frank E. Barnes, 8557 Capital of Texas Highway, Apt. 1115, Austin, Tex. 78946

[21] Appl. No.: 681,363

[22] Filed: Dec. 13, 1984

[51] Int. Cl.[4] ..... A24F 1/26; A24F 3/02

[52] U.S. Cl. ..... 131/181; 131/198.1; 131/183; 131/184.2; 131/184.3

[58] Field of Search ..... 131/198 R, 181, 182, 131/183, 215 A, 202, 246, 180, 329, 184.1–184.3

[56] References Cited

U.S. PATENT DOCUMENTS

| | | | |
|---|---|---|---|
| 253,512 | 2/1882 | Cole | 131/198.1 |
| 1,505,096 | 8/1924 | Ivoty | 131/198.1 |
| 1,630,242 | 5/1927 | Rosan | 131/182 |
| 2,671,453 | 3/1954 | Gans | 131/183 |
| 3,292,638 | 12/1966 | Lorquet | 131/183 |
| 3,765,428 | 10/1973 | Beam | 131/198.1 |
| 4,524,782 | 6/1985 | Chister | 131/180 |

*Primary Examiner*—R. V. Millin
*Assistant Examiner*—H. Macey
*Attorney, Agent, or Firm*—Bill B. Berryhill

[57] ABSTRACT

Smoking apparatus comprising a tubular chimney having a cylindrical interior open at both ends and in which a charge of smoking material may be placed. A conduit may be provided in fluid communication with the chimney and an air inlet. Smoke from the burning of said smoking material entrained with air from the air inlet through the conduit may be drawn through the conduit by the smoker. A plunger engages the cylindrical interior of the chimney and is reciprocally movable relative thereto for displacing burned smoking material from the chimney.

4 Claims, 4 Drawing Figures

SMOKING APPARATUS

BACKGROUND OF THE INVENTION

1. Field of the Invention

The present invention pertains to smoking apparatus. Specifically, it pertains to smoking apparatus, such as a pipe, in which the smoking material is placed in a reservoir or container area which is in fluid communication with a conduit, such as a pipe stem, through which smoke from the burning of the smoking material may be drawn by the mouth of the smoker.

2. Brief Description of the Prior Art

Smoking apparatus such as pipes are made in various sizes, shapes and arrangements. However, most of them are constructed with a small container or bowl to which a slender conduit or tube is attached for fluid communication with the bottom of the bowl. Smoke from the burning of the smoking material may be drawn by the mouth of the smoker through the bowl and the slender tube. Some pipes are also provided with an air inlet through which additional air may be drawn through the tube along with the smoke from the burning material.

One of the most troublesome aspects of a pipe is that it must be frequently dumped and cleaned of the burned smoking material. This process is quite messy and troublesome. Furthermore, it prevents the smoker from smoking as long as he might wish since there is a limit as to how much smoking material may be placed in the bowl. Another problem with smoking apparatus of the prior art is that after a period of time, the air being drawn through the smoking apparatus travels through more burned smoking material than non-burned, leaving a less than desired taste and effect.

As previously stated, the pipes and smoking apparatus of the prior art are sometimes quite messy. Smoking material, particularly burned material, frequently spills from the bowl. They require frequent tapping against a solid object to clean. The bowl requires frequent cleaning which is rather difficult, especially since the bowl normally accumulates stubborn oils and other residue. Most smoking apparatus of the prior art is not easily disassembled for thorough cleaning.

SUMMARY OF THE INVENTION

In the present invention, smoking apparatus is provided with a tubular chimney having a cylindrical interior open at both ends and in which a charge of smoking material may be placed. There is a conduit in fluid communication with the chimney and through which smoke from the burning of the smoking material may be drawn by the mouth of the smoker. An air inlet is provided through which air may be drawn through the conduit and by which smoke from the chimney may be entrained therewith. A plunger device engages the cylindrical interior of the chimney and is reciprocally movable relative thereto for displacing burned smoking material from the chimney.

The inter-cooperation of the tubular chimney and the plunger device is unique. This arrangement allows the filling of the tubular chimney with a much larger charge of smoking material. The plunger device may be used to properly load the smoking material therein. Furthermore, the plunger device allows the displacement of burned smoking material from the chimney without displacing the remaining unburned smoking material. In doing so, the burned material is easily and cleanly removed without the messy cleaning techniques for smoking apparatus of the prior art. This procedure, of course, also requires less loading of the smoking apparatus.

Even though the unique design of the tubular chimney and plunger device results in less loading, it can be easily and quickly reloaded. Because of the manner in which the chimney and plunger are assembled, the chimney may be easily separated from the plunger device for cleaning. Even though it requires less frequent cleaning, it can be cleaned in seconds using hot tap water.

In addition, the smoking apparatus of the present invention performs better than smoking apparatus of the prior art. The smoking material burns more efficiently therein. While the strength of the draw may be intensified, the smoking harshness is reduced. Many other objects and advantages of the invention will be apparent from reading the description which follows in conjunction with the accompanying drawings.

DESCRIPTION OF PREFERRED EMBODIMENTS

Figure 1:
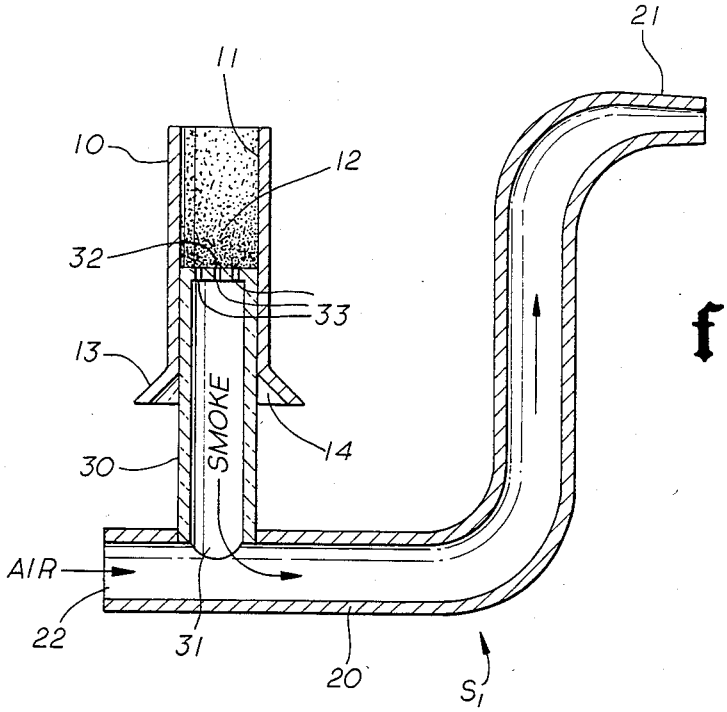
FIG. 1 is a side elevation view, in section, of smoking apparatus according to a preferred embodiment of the invention.
Figure 2:
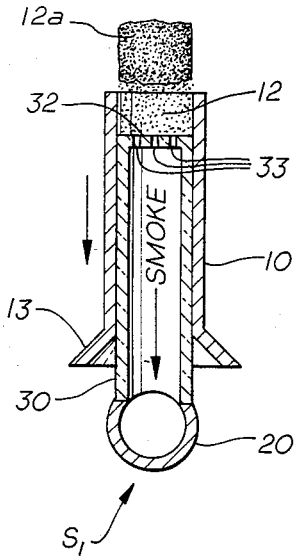
FIG. 2 is an end elevation view, in section, of the preferred embodiment of the invention shown in FIG. 1.

Referring first to FIGS. 1 and 2, there is shown smoking apparatus $S_1$ comprising three major subassemblies, a tubular chimney 10, conduit means 20 and plunger means 30. The tubular chimney 10 has a cylindrical interior 11 open at both ends and in which a charge of smoking material 12 may be placed. One end 13 of the tubular chimney 10 may be flared to provide a funnel area 14 which allows easier loading of the smoking material 12 as will be more fully understood hereafter.

Conduit means subassembly 20 is in fluid communication with the chimney 10, as will be more fully understood hereafter, so that smoke from the burning of the smoking material 12 may be drawn through the conduit 20 by the mouth of the smoker, engaging the mouth piece 21 and drawing thereon. The conduit means 20 may also be provided with an air inlet 22.

Attached to the conduit means 20 is a plunger means 30 which in the exemplary embodiment of FIGS. 1 and 2 is fixed relative to the conduit means 20. The plunger means 30 comprises a tubular member having an open end 31 and the opposite end of which is closed by a perforated end wall 32. The perforations 33 allow smoke from the burning of the smoking material 12 to communicate with the conduit means 20 through the open end 31 of the plunger means 30. However, the perforations 33 are too small to allow smoking material 12 to pass therethrough. The plunger means 30 may be made of a number of materials. However, it is contemplated that it would be made of glass.

It will be noted that the cylindrical exterior of the tubular plunger 30 and the cylindrical interior of the tubular chimney 10 are in sliding engagement. Thus, the plunger means 30 engages the cylindrical interior 11 of the chimney 10 for reciprocal movement relative thereto.

With the smoking apparatus $S_1$ in the relative positions of FIG. 1, the smoking material 12 may be lit and smoke and air drawn through the conduit means 20 by the mouth of the smoker engaging the mouthpiece 21 and drawing therethrough. The smoke from the burning smoking material 12 passes through the perforations 33 and the interior of the plunger means 30 and the open end thereof 31 for entrainment with air being drawn through the air inlet 22.

After a period of time, when a portion of the smoking material 12 has been burned, as illustrated in 12*a* at FIG. 2, the tubular chimney 10 may be moved downwardly as illustrated by the arrow to the left thereof in FIG. 2 so that the burned portion 12*a* of the smoking material is exposed above the upper end of the tubular chimney 10. The burned material 12*a* may then be removed by brushing or light tapping of the smoking apparatus $S_1$ and smoking continued with the remaining unburned smoking material 12.

It can be easily understood that loading of the smoking apparatus $S_1$ can easily be accomplished by totally removing the tubular chimney member 10 from the remainder of the apparatus. It may be inverted and the index finger placed so as to cover the inverted opening while small amounts of smoking material are placed in the chimney 10 through the funnel 14 of the flared end 13. If desired, a small tamper may be used to lightly compress the contents in the chimney. After loading, the chimney may be turned to the correct position and reassembled as shown in FIG. 1.

Since the chimney 10 is so easily removable, it may be removed for cleaning. The open-ended cylindrical interior makes it easy to clean and in fact, it can normally be cleaned in seconds by running hot tap water therethrough. With the chimney 10 removed, the other components of the smoking apparatus $S_1$ can also be easily cleaned.

In addition, the smoking apparatus $S_1$ is extremely safe. All unburned tobacco extending beyond the tip of the chimney 10 will smolder. However, as the burning ember reaches the tip of the chimney 10, the smoking material will extinguish itself in a few seconds unless the smoker is drawing air therethrough.

Figure 4:
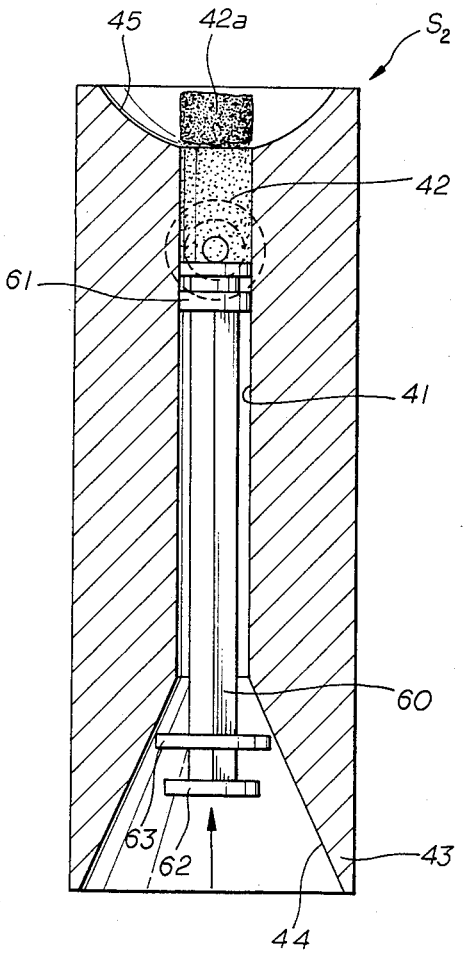
FIG. 4 is an end elevation view, partially in section, of the smoking apparatus of FIG. 3.
Figure 3:
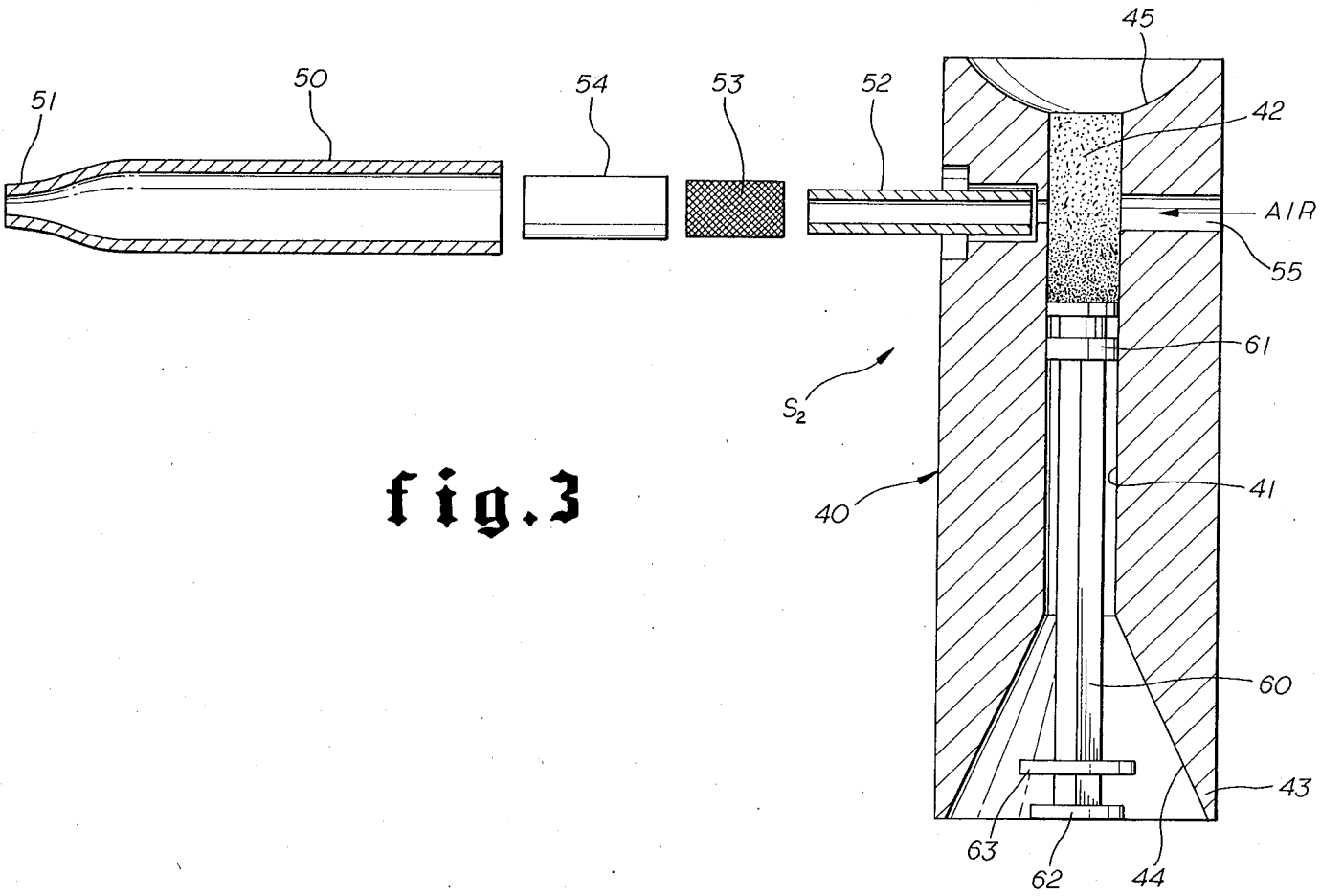
FIG. 3 is a side elevation view, partially in section, of an alternate embodiment of the invention, portions of which are shown disassembled.

Referring now to FIGS. 3 and 4, an alternate embodiment of the invention will be shown in which the plunger means is located in a different fashion. Like in the previous embodiment, the smoking apparatus $S_2$ of this embodiment is provided with three major subassemblies, the tubular chimney 40, conduit assembly 50 and plunger means 60.

The tubular chimney 40 is provided with a cylindrical interior 41 in which the charge of smoking material 42 may be placed. The lower end 43 of the chimney 40 is flared to provide a funnel area 44 to allow easier loading of the chimney 40. Even though it is not required, a bowl 45 may be provided at the opposite end of the chimney 40.

The conduit means 50 may be provided with a mouthpiece 51 by which smoke and air may be drawn through the conduit 50 from the burning smoking material 42 and an air inlet 55 through the ends of chimney 40. The conduit 50 may be connected in fluid communication with the smoking material 42 and air inlet 55 through a port in which an adapter or connector 52 is shown. In addition, a filter 53 and sleeve 54 may be provided. As shown in FIG. 3, these items are disassembled. However, on assembly, the screen 53 would be placed around one end of the adapter 52 and the sleeve 54 surrounding the screen 53 and adapter 52 with all of these components being surrounded by one end of the conduit 50.

In the embodiment of FIGS. 3 and 4, the plunger 60 is provided with a plunger head or piston 61 which closely but slidingly engages the cylindrical interior 41 of the chimney member 40. A push plate 62 may be provided at the opposite end of the plunger 60 and a stop flange 63 may also be provided therein.

To load the smoking apparatus $S_2$ the plunger 60 is removed from the chimney 40 and the chimney inverted. Small amounts of smoking material are then loaded into the cylindrical interior 41 through the funnel area 44 while the index finger is placed over the end of the cylindrical interior 41 in the area of the bowl 45. The smoking material 42 may be lightly tamped in place. Then the plunger 60 is reinserted and the smoking apparatus $S_2$ returned to the normal disposition shown in FIG. 3. When the smoking material 42 is lit, smoke from the burning thereof is entrained with air through the air inlet 55 and drawn through the conduit 50.

After a period of time, some of the smoking material is burned, as illustrated at 42*a* in FIG. 4. As this occurs, plunger 60 may be pushed upwardly in the cylindrical interior 41, as illustrated in FIG. 4, to expose the burned smoking material 42*a* where it may be easily removed. The stop flange 63 limits how far the plunger 60 may be pushed upwardly.

Thus, the smoking apparatus of the present invention provides a very unique construction, particularly in the provision of a tubular chimney and a plunger means which engages the cylindrical interior of the chimney and is reciprocal relative thereto. This allows easy displacement of burned smoking material from the chimney. In addition to the displacement of burned smoking material, the smoking apparatus of the present invention offers many other advantages, including: more efficient burning, less loading, reduced harshness, easy cleaning, safe burning and others.

While only two embodiments of the invention have been described herein, many variations thereof can be made without departing from the spirit of the invention. Thus, it is intended that the scope of the invention be limited only by the claims which follow.

I claim:

1. Smoking apparatus comprising:

a tubular chimney having a cylindrical interior open at both ends and in which a charge of smoking material may be placed;

conduit means in fluid communication with said chimney and through which smoke from the burning of said smoking material may be drawn by the mouth of a smoker;

an air inlet in fluid communication with said conduit means and through which air may be drawn for entrainment of said smoke therewith from said chimney; and plunger means engaging said cylindrical interior of said chimney and reciprocally movable relative thereto for displacing burned smoking material from said chimney;

said tubular chimney being fixed relative to said conduit means, said plunger means being insertable into said chimney interior from the end of said chimney opposite the end at which said smoking material is burned for loading of said smoking material charge in said cylindrical interior and for said displacement of burned material therefrom; and the end of said tubular chimney, opposite the end in which said smoking material is burned, being flared to provide a funnel area adjacent said cylindrical interior and by which smoking material may be more easily loaded into said tubular chimney.

2. Smoking apparatus as set forth in claim 1 in which said air inlet and said conduit means communicate with said chimney interior on the opposite sides thereof.

3. Smoking apparatus as set forth in claim 1 including a perforated barrier between said chimney interior and said conduit means the perforations of which allow said smoke to communicate with said conduit means but which are small enough to prevent said smoking material from passing therethrough.

4. Smoking apparatus as set forth in claim 1 in which said plunger means is removable from said chimney interior to allow cleaning of said chimney and filling with said smoking material.

* * * * *